US006290002B1

(12) United States Patent
Comeau et al.

(10) Patent No.: US 6,290,002 B1
(45) Date of Patent: Sep. 18, 2001

(54) PNEUMATIC HAMMER DRILLING ASSEMBLY FOR USE IN DIRECTIONAL DRILLING

(75) Inventors: Laurier E. Comeau; Ian Gillis, both of Leduc; James Fehr, Sherwood Park; Christopher W. Konschuh, Leduc, all of (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/245,063

(22) Filed: Feb. 5, 1999

(30) Foreign Application Priority Data

Feb. 3, 1999 (CA) ..... 2260612

(51) Int. Cl.[7] ..... E21B 7/04

(52) U.S. Cl. ..... 175/73; 175/61

(58) Field of Search ..... 175/61, 73, 76, 175/325.5, 415

(56) References Cited

U.S. PATENT DOCUMENTS

| | | | | |
|---|---|---|---|---|
| Re. 33,751 | | 11/1991 | Geczy et al. . | |
| 4,106,571 | * | 8/1978 | Stone | 173/64 |
| 4,163,478 | | 8/1979 | Adcock . | |
| 4,407,377 | | 10/1983 | Russell . | |
| 4,491,187 | | 1/1985 | Russell . | |
| 4,530,408 | | 7/1985 | Toutant . | |
| 4,667,751 | | 5/1987 | Geczy et al. . | |
| 4,754,821 | * | 7/1988 | Swietlik | 175/325.5 |
| 4,919,221 | | 4/1990 | Pascale . | |
| 4,962,822 | | 10/1990 | Pascale . | |
| 5,139,094 | | 8/1992 | Prevedel et. al. . | |
| 5,156,222 | * | 10/1992 | Jurgens et al. | 175/61 |
| 5,181,576 | | 1/1993 | Askew et. al. . | |
| 5,205,363 | | 4/1993 | Pascale . | |
| 5,265,684 | | 11/1993 | Rosenhauch . | |
| 5,293,945 | | 3/1994 | Rosenhauch et. al. . | |
| 5,305,837 | | 4/1994 | Johns . | |
| 5,311,953 | * | 5/1994 | Walker | 175/61 |
| 5,322,136 | | 6/1994 | Bui et. al. . | |
| 5,332,048 | * | 7/1994 | Underwood et al. | 175/61 |
| 5,435,402 | | 7/1995 | Ziegenfuss . | |
| 5,564,510 | | 10/1996 | Walter . | |
| 5,803,187 | * | 9/1998 | Javins | 175/415 |
| 6,092,610 | * | 7/2000 | Kosmala et al. | 175/61 |

FOREIGN PATENT DOCUMENTS

WO9924688 5/1999 (WO) .

OTHER PUBLICATIONS

NUMA Champion 40 Care & Maintenance Instructions Manual, Jul. 1998, pp. 11–12.

(List continued on next page.)

*Primary Examiner*—Thomas B. Will
*Assistant Examiner*—Nathan Mammen
(74) *Attorney, Agent, or Firm*—Terrence N. Kuharchuk; Michael D. McCully; William Shull

(57) ABSTRACT

A drilling assembly and a method for directional drilling using the drilling assembly. The drilling assembly comprises a drilling bit, a near bit stabilizer and an adjustable gauge stabilizer. The near bit stabilizer is located a first axial distance from a distal end of the drilling assembly and has a near bit stabilizer gauge which is greater than a nominal drilling assembly gauge. The adjustable gauge stabilizer is located a second axial distance from the distal end, which is greater than the first axial distance, and is adjustable between an extended and retracted gauge. The retracted gauge is less than the near bit stabilizer gauge. A bit drop angle is created between the drilling assembly and the drilling bit, while a stabilizer angle is created between the near bit stabilizer and the adjustable gauge stabilizer. The combination of the bit drop angle and the stabilizer angle results in a net build angle of the drilling assembly, when the adjustable gauge stabilizer is adjusted to the retracted gauge, and a net drop angle when adjusted to the extended gauge.

12 Claims, 5 Drawing Sheets

OTHER PUBLICATIONS

Pratt, C.A., "Modifications to and Experience With Percussion Air Drilling," SPE/IADC 16166, pp. 1017–1026, presented at the 1987 SPE/IADC Drilling Conference, Mar. 15–18, 1987.

Whitely, M.C. et. al., "Air Drilling Operations Improved by Percussion Bit/Hammer Tool Tandem," SPE/IADC 13429, pp. 61–70, presented at the 1985 SPE/IADC Drilling Conference, Mar. 6–8, 1985.

Drilco, Divison of Smith International, Inc., "Bit Stabilization and Packed Hole Assemblies," Publication No. E–103, undated, 7 pages.

Bui, H.D. et. al., "Steerable Percussion Air Drilling System," Proceedings of the Natural Gas R&D Contractors Review Meeting, U.S. Department of Energy, DOE/METC–95/1017 (DE95009704), Apr. 1995, pp. 537–541.

Wilson, G.E., "How to Drill a Usable Hole, Part 1–Why deviation occurs," *World Oil*, Aug.–Nov. 1976 (4 pages).

Wilson, G.E., "How To Drill A Usable Hole, Part 2–Designing the bottomhole assembly," *World Oil*, Aug.–Nov. 1976 (5 pages).

Petroleum Industry Training Service, *Drilling Engineering, vol. 1*, Chapter 3—Drilling Rig and Ancillaries, Apr. 1995, pp. 3–203 to 3–214.

Petroleum Industry Training Service, *Drilling Engineering, vol. 2*, Chapter 12—Directional Drilling, Apr. 1995, pp. 12–26 to 12–32.

Sperry–Sun Drilling Services, a division of Dresser Industries, Inc., Operations Manual for Adjustable Gauge Stabilizer (AGS) dated 1997 (62 pages).

Sperry–Sun Drilling Services Inc., catalogue entitled "Sourcebook," 1996. p. 53—AGS Adjustable Gauge Stabilizer.

Sperry–Sun Drilling Services, Inc., "Sperry Drill Technical Information Handbook," undated, pp. 2–17.

* cited by examiner

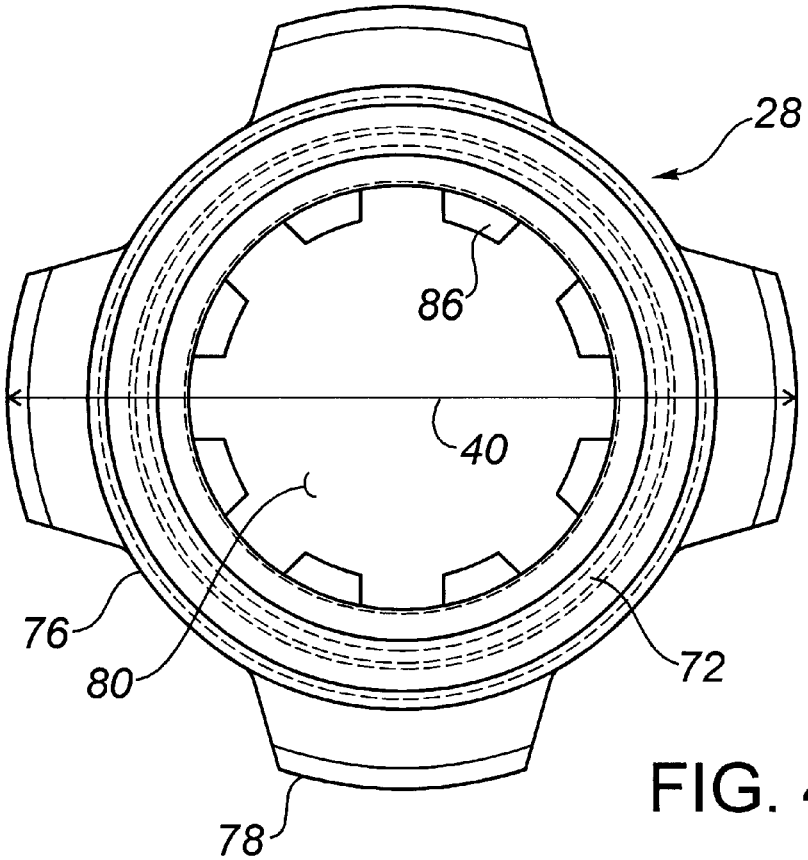
FIG. 4
FIG. 5
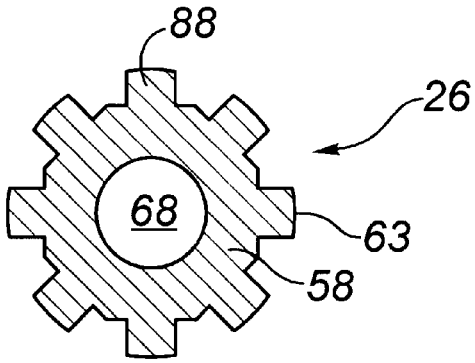

PNEUMATIC HAMMER DRILLING ASSEMBLY FOR USE IN DIRECTIONAL DRILLING

TECHNICAL FIELD

The present invention relates to a pneumatic hammer drilling assembly which may be used for directional drilling and a method for drilling using the drilling assembly.

BACKGROUND OF THE INVENTION

In pneumatic hammer or percussion drilling, rate of penetration (ROP) is achieved by impacting the end of the borehole with a reciprocating hammer bit, in contrast with conventional rotary bit drilling, where ROP is achieved by the shearing of material at the end of the borehole. Pneumatic hammer drilling can often result in a greater ROP than can be achieved by rotary bit drilling due to the relative efficiency with which the drilling energy can be delivered to the end of the borehole.

Typically, pneumatic hammer drilling involves rotating the hammer bit while it is reciprocating so that the impact elements of the hammer bit do not repeatedly impact upon the same location at the end of the borehole. Rotation of the hammer bit can be accomplished either by rotating the hammer bit together with the drilling assembly and the drill string (as in rotary drilling), or by rotating the hammer bit independently without rotating the drilling assembly and the drill string (as in sliding drilling). Rotary drilling is typically used in non-directional drilling where control over the orientation of the resulting borehole is not critical, while sliding drilling is typically used in directional drilling where control over the orientation of the resulting borehole is desirable.

Rotation of the hammer bit together with the drill string is typically accomplished by providing compatible splines, or an alternative positive connection, between the drill string or other components of the drilling assembly and the hammer bit such that rotation of the drill string, by a rotary table typically mounted on the rig platform, may be transferred to the hammer bit. While rotating, the hammer bit is also reciprocated by the pneumatic hammer to impact the end of the borehole.

For example, a pneumatic hammer used for rotary drilling is described in U.S. Pat. No. 4,163,478 issued Aug. 7, 1979 to Adcock, U.S. Pat. No. 4,530,408 issued Jul. 23, 1985 to Toutant, U.S. Pat. No. 4,919,221 issued Apr. 24, 1990 to Pascale, U.S. Pat. No. 4,962,822 issued Oct. 16, 1990 to Pascale, U.S. Pat. No. 5,205,363 issued Apr. 27, 1993 to Pascale and U.S. Pat. No. 5,564,510 issued Oct. 15, 1996 to Walter.

As described in the above noted patents, the hammer bit includes an impact head at one end, for impacting the formation, and a drive shank at the other end, including an anvil end face. A pneumatic downhole hammer is connected at an upper end to the drill string or other components of the drilling assembly and is connected at a lower end to the drive shank of the hammer bit by a splined connection. As a result, rotation of the drill string rotates the hammer, which correspondingly rotates the hammer bit. Further, the hammer comprises an impact piston for engagement with the anvil end face of the hammer bit. Specifically, reciprocation of the impact piston of the hammer pneumatically results in the reciprocation of the hammer bit.

Thus, during drilling, pneumatic pressure fluid under high pressure is conducted via the drill string to the hammer for pneumatic reciprocation of the impact piston. Further, the drill string is employed for rotating the downhole hammer and bit during the drilling operation in a clockwise direction. As well, a compressive axial force is applied through the drill string to the drilling assembly such that a downward force may be maintained on the impact head of the hammer bit during drilling. More particularly, a proper weight-on-bit must be maintained in order to optimize the operation of the hammer and ensure proper transmission of impact energy from the hammer to the bit. Excess weight-on-bit may prevent the efficient operation of the hammer, while too light a weight-on-bit may allow the bit to oscillate off bottom and not transmit impact energy to the end of the borehole.

Alternately, as indicated, the hammer bit may be rotated independently without rotating the drilling assembly or the drill string. For example, in U.S. Pat. No. 5,305,837 issued Apr. 26, 1994 to Johns and U.S. Pat. No. 5,322,136 issued Jun. 21, 1994 to Bui et. al., the air hammer assembly impacts and simultaneously rotates a hammer bit independently of the drill string. Accordingly, the air hammer assembly is described as having specific application for controlled directional drilling.

More particularly, these air hammer assemblies also include a reciprocating piston. However, the kinetic energy of the reciprocating piston is employed to rotate the bit. The linear or axial motion of the piston is converted into rotational motion by using one or more helical grooves formed by the piston body. Further, to prevent the piston from oscillating in the rotary mode, an indexing clutch is provided to induce or permit rotation of the bit in one direction only. The upper portion of the hammer bit, which is normally splined, is replaced by a shaft which is slidably engaged with and keyed to a complimentary shaped female receptacle or bore formed by the lower portion of the piston. Therefore, the shaft of the hammer bit is at all times slidably engaged with the piston and is rotated thereby. Specifically, downward motion of the piston causes the bit to rotate in a clockwise direction. Upward motion of the piston rotates the inner race of the indexing clutch and prevents the bit from rotating in a counterclockwise direction.

U.S. Pat. No. 5,435,402 issued Jul. 25, 1995 to Ziegenfuss describes a further hammer bit which is also rotatable independently without rotating the drilling assembly or drill string. Specifically, a hammer bit member has an elongated body with a hollow area therein and at least one blade located in the hollow area. The blade or blades are adapted to receive pressurized air in order to impart a rotation to the hammer bit member, which has the hammer bit located at its distal end. A reciprocation mechanism, including a reciprocating piston, is connected to the other end of the hammer bit member in order to impart vertical reciprocation of the hammer bit member in response to the pressurized air. As a result, upon application of the air pressure, the hammer piston is activated to cause a reciprocal vertical motion, and at the same time, the air pressure impacts or impinges upon the blades to cause the hammer bit member to rotate.

Directional drilling may be defined as deflection of a borehole along a predetermined path in order to reach or intersect with a specific subterranean formation or target. The predetermined path typically includes a depth where initial deflection occurs and a schedule of desired deviation angles and directions over the remainder of the borehole. Thus, deflection is a change in the direction of the borehole from the current borehole path.

Deflection is measured as an amount of deviation of the borehole from the current borehole path and is expressed as a deviation angle or hole angle. Commonly, the initial borehole path is in a vertical direction. Thus, initial deflection often signifies a point at which the borehole has deflected off vertical. As a result, deviation is commonly expressed as an angle in degrees from vertical.

While directional drilling, in order to reach the desired subterranean formation or target, the deviation or hole angle may be increased or decreased as necessary. An increase in the deviation or hole angle is referred to as a build angle and produces a build rate and a build section of the borehole. A decrease in the deviation or hole angle is referred to as a drop angle and produces a drop rate and a drop section of the borehole.

When drilling an inclined hole, the forces which act upon the drilling bit, and which affect the resulting direction of the drilled borehole, may be resolved into three components: axial load, pendulum force and formation reaction. The axial load is a compressive axial force and is typically supplied by the weight of the drilling assembly and attached drill string. The pendulum force is a lateral force which results from the weight of the drilling assembly between the drilling bit and a first or lowermost point of contact of the wall of the borehole with the drilling assembly. The pendulum force is the tendency of the unsupported length of the drilling assembly to swing over against the low side of the borehole because of gravity. The formation reaction is the reaction of the formation to the axial load and pendulum load. Commonly, where the hole angle is desired to be reduced, or a drop angle is desired, a pendulum technique may be employed which utilizes the pendulum force and gravity to bring the borehole back towards vertical.

Further, when directional drilling, by either rotary drilling or sliding drilling, the use of a stabilizer in the bottom hole assembly can assist in controlling the direction of the borehole. More particularly, the primary purpose of using stabilizers in the bottom hole assembly is to stabilize the drilling bit that is attached to the distal end of the bottom hole assembly so that it rotates properly on its axis. A secondary purpose of using stabilizers in the bottom hole assembly is to assist in steering the drill string so that the direction of the borehole can be controlled. For example, properly positioned stabilizers can assist either in increasing or decreasing the deflection angle of the borehole either by supporting the drill string near the drilling bit or by not supporting the drill string near the drilling bit.

Conventional stabilizers can be divided into two broad categories. The first category includes rotating blade stabilizers which are incorporated into the drill string and either rotate or slide with the drill string. The second category includes non-rotating sleeve stabilizers which typically comprise a ribbed sleeve rotatably mounted on a mandrel so that during drilling operations, the sleeve does not rotate while the mandrel rotates or slides with the drill string. Rotating blade type stabilizers are far more common and versatile than non-rotating sleeve stabilizers, which tend to be used primarily in hard formations and where only mild wellbore deflections are experienced.

The specific design of a bottom hole assembly requires consideration of where, what type and how many stabilizers should be incorporated into the drill string. In addition, the specific gauge of the stabilizer must be taken into consideration. Further, since it is usually necessary to adjust the direction of the borehole frequently during directional drilling, the desired type, number and location of stabilizers in the drill string may vary from time to time during drilling. As a result, when directional drilling, the entire drill string may need to be removed from the borehole in order to add or remove such conventional stabilizers to or from the drill string when a change in direction of the borehole is desired. Both adjustment of the stabilizers and the bottom hole assemblies is frequently required. This is extremely costly and time consuming.

As a result, various methods and techniques have been developed which attempt to provide a manner of controlling the direction of the resulting borehole while drilling without the need to remove the drilling assembly from the borehole. However, none of these methods or techniques are completely satisfactory.

For example, U.S. Pat. No. Re. 33,751 reissued Nov. 26, 1991 to Geczy utilizes a plurality of stabilizers to control the direction of the resulting borehole. More particularly, Geczy provides an overall system approach to design the hardware for drilling according to a specific desired well plan. Specifically, the bend angle of a bent housing, the diameter of a plurality of stabilizers, the placement of the stabilizers with respect to the drill bit and the weight on bit must all be selected and predetermined on the basis of the specific desired well plan. In other words, the bottom hole assembly must be uniquely tailored for each proposed well plan. As well, the system uses at least three, and preferably four, concentric stabilizers which are precisely located along the drill string.

Utilizing the specialized system of Geczy, direction changes are controlled by controlling the rotation of the drill string. For curved path drilling, only the downhole motor is rotated, causing the borehole to travel along the curve determined by the bend angle in the bent housing and the diameter and location of the concentric stabilizers. When straight hole drilling is required, both the downhole motor and the entire string are rotated.

As a result, there remains a need in the industry for a downhole drilling assembly and a drilling method for use in directional drilling, which provide the ability to control the direction of the resulting borehole. More particularly, there is a need for a downhole drilling assembly and a drilling method for use in directional drilling, which provide the ability to control the direction of the resulting borehole, when rotary drilling or sliding drilling using a reciprocating hammer bit. Further, there is a need for such a drilling assembly and drilling method capable of selectively producing an increase in the deviation angle of the borehole or producing a build angle or build section for building the borehole. Finally, there is a need for the drilling assembly and drilling method to also be capable of selectively producing a decrease in the deviation angle of the borehole or producing a drop angle or drop section for dropping the borehole.

SUMMARY OF THE INVENTION

The within invention is directed at a drilling assembly for use in directional drilling and a method for drilling a borehole with the use of a drilling assembly. Both the downhole drilling assembly and the drilling method are particularly for use in directional drilling in order to provide or enhance the ability to control the direction of the resulting borehole. The drilling assembly and method may be used to assist in controlling the direction of the resulting borehole when either rotary drilling or sliding drilling. However, preferably, the drilling assembly and method are used to assist in controlling the direction of the resulting borehole when rotary drilling.

The drilling assembly and the drilling method are capable of producing an increase in the deviation angle of the borehole or producing a build angle or build section for building the borehole. Preferably, the drilling assembly and the drilling method are also capable of producing a decrease in the deviation angle of the borehole or producing a drop angle or drop section for dropping the borehole. More preferably, the drilling assembly and the drilling method are capable of selectively producing either a build section or a drop section, as desired by the user. Further, the build angle and the drop angle are preferably achievable or producable without the need to remove the drill string and the drilling assembly from the borehole for adjustment or re-configuration.

In a first aspect of the invention, the invention is comprised of a drilling assembly for use in directional drilling, wherein the drilling assembly has a nominal drilling assembly gauge. The drilling assembly comprises:

(a) a drilling bit, wherein the drilling bit has a distal end which defines a distal end of the drilling assembly;

(b) a near bit stabilizer located a first axial distance from the distal end of the drilling assembly, wherein the near bit stabilizer has a near bit stabilizer gauge and wherein the near bit stabilizer gauge is greater than the nominal drilling assembly gauge;

(c) an adjustable gauge stabilizer located a second axial distance from the distal end of the drilling assembly, wherein the second axial distance is greater than the first axial distance, wherein the adjustable gauge stabilizer is adjustable between an extended gauge and a retracted gauge, and wherein the retracted gauge is less than the near bit stabilizer gauge;

wherein the drilling bit is supported in the drilling assembly such that a bit drop angle is created between the drilling assembly and the drilling bit, wherein a stabilizer angle is created between the near bit stabilizer and the adjustable gauge stabilizer, and wherein the combination of the bit drop angle and the stabilizer angle results in a net build angle of the drilling assembly when the adjustable gauge stabilizer is adjusted to the retracted gauge.

In a second aspect of the invention, the invention is comprised of a method for drilling a borehole with the use of a drilling assembly positioned in the borehole. In a first embodiment of the method, the drilling assembly comprises a drilling bit having a distal end which defines a distal end of the drilling assembly, a near bit stabilizer located a first axial distance from a distal end of the drilling assembly, and an adjustable gauge stabilizer located a second axial distance from the distal end of the drilling assembly, the second axial distance being greater than the first axial distance, the adjustable gauge stabilizer being adjustable between an extended gauge and a retracted gauge, the drilling assembly having a net build angle when the adjustable gauge stabilizer is adjusted to the retracted gauge. The first embodiment of the method comprises the following steps:

(a) adjusting the adjustable gauge stabilizer to the retracted gauge; and (b) drilling a build section in the borehole using the drilling bit with the adjustable gauge stabilizer adjusted to the retracted gauge.

In a second embodiment of the method, the drilling assembly comprises a pneumatic hammer comprising a reciprocatable hammer bit having a distal end which defines a distal end of the drilling assembly, a near bit stabilizer located a first axial distance from a distal end of the drilling assembly, and an adjustable gauge stabilizer located a second axial distance from the distal end of the drilling assembly, the second axial distance being greater than the first axial distance, the adjustable gauge stabilizer being adjustable between an extended gauge and a retracted gauge, the drilling assembly having a net build angle when the adjustable gauge stabilizer is adjusted to the retracted gauge. The second embodiment of the method comprises the following steps:

(a) adjusting the adjustable gauge stabilizer to the retracted gauge;

(b) drilling a build section in the borehole by reciprocating the hammer bit with the adjustable gauge stabilizer adjusted to the retracted gauge.

The drilling assembly is adapted to be positioned in a borehole for directional drilling. The drilling assembly and method may be used when sliding drilling, but are preferably used when rotary drilling. In either case, the drilling bit is preferably adapted to rotate in the borehole during drilling. Thus, the method preferably includes the further step of rotating the drilling bit during drilling. The drilling bit preferably rotates with the drilling assembly, however, the drilling bit may rotate independently of the drilling assembly.

The drilling bit may be comprised of any drilling bit capable of drilling the desired borehole and capable of providing the desired bit drop angle when supported by the drilling assembly. For instance, the drilling bit may be comprised of a rotary drilling bit for shearing material at the end of the borehole. However, preferably, the drilling bit is comprised of a reciprocatable hammer bit. The hammer bit may be actuated in any manner and by any mechanism. However, the drilling assembly is preferably comprised of a pneumatic hammer associated with the reciprocatable hammer bit.

As indicated, the drilling bit preferably rotates during the drilling operation. Thus, in the preferred embodiment, the drilling bit, and in particular the hammer bit, reciprocates and rotates during drilling. In other words, the method preferably further comprises the step of rotating the hammer bit as the hammer bit reciprocates.

The drilling bit, and in particular the hammer bit, preferably rotates with the drilling assembly. Thus, the hammer bit is preferably adapted to rotate with the drilling assembly as the hammer bit reciprocates. Alternately, the drilling bit, and in particular the hammer bit, may rotate independently of the drilling assembly. Thus, the hammer bit may be adapted to rotate independently of the drilling assembly as the hammer bit reciprocates.

Further, the drilling assembly has a net build angle when the adjustable gauge stabilizer is adjusted to the retracted gauge. In addition, the drilling assembly preferably further has a net drop angle when the adjustable gauge stabilizer is adjusted to the extended gauge. Thus, in the drilling assembly, the combination of the bit drop angle and the stabilizer angle results in a net drop angle of the drilling assembly when the adjustable gauge stabilizer is adjusted to the extended gauge. As well, the method further comprises the following steps:

(c) adjusting the adjustable gauge stabilizer to the extended gauge;

(d) drilling a drop section in the borehole by reciprocating the hammer bit with the adjustable gauge stabilizer adjusted to the extended gauge.

The near bit stabilizer may be comprised of any structure or mechanism able to be positioned within the borehole in proximity to the drilling bit which is capable of stabilizing the drilling bit during drilling operations. Thus, any stabilizer, and in particular, any near bit stabilizer, may be used.

Similarly, the adjustable gauge stabilizer may be comprised of any structure or mechanism able to be positioned within the borehole for stabilizing the drilling assembly and which is capable of adjustment between the extended gauge and the retracted gauge. Thus, any adjustable gauge stabilizer may be used. For instance, the adjustable gauge stabilizer may be capable of adjustment between a fully extended gauge and a fully retracted gauge or it may be adjustable to an infinite number of positions therebetween such that varying degrees of extension or retraction are possible to provide the extended and retracted gauges.

BRIEF DESCRIPTION OF DRAWINGS

Embodiments of the invention will now be described with reference to the accompanying drawings, in which:

FIG. 4 is an end view of the near bit stabilizer taken along line 4—4 of FIG. 3(*b*);

FIG. 5 is a cross-sectional view of the drilling bit taken along line 5—5 of FIG. 3(*b*)

DETAILED DESCRIPTION

Figure 1:
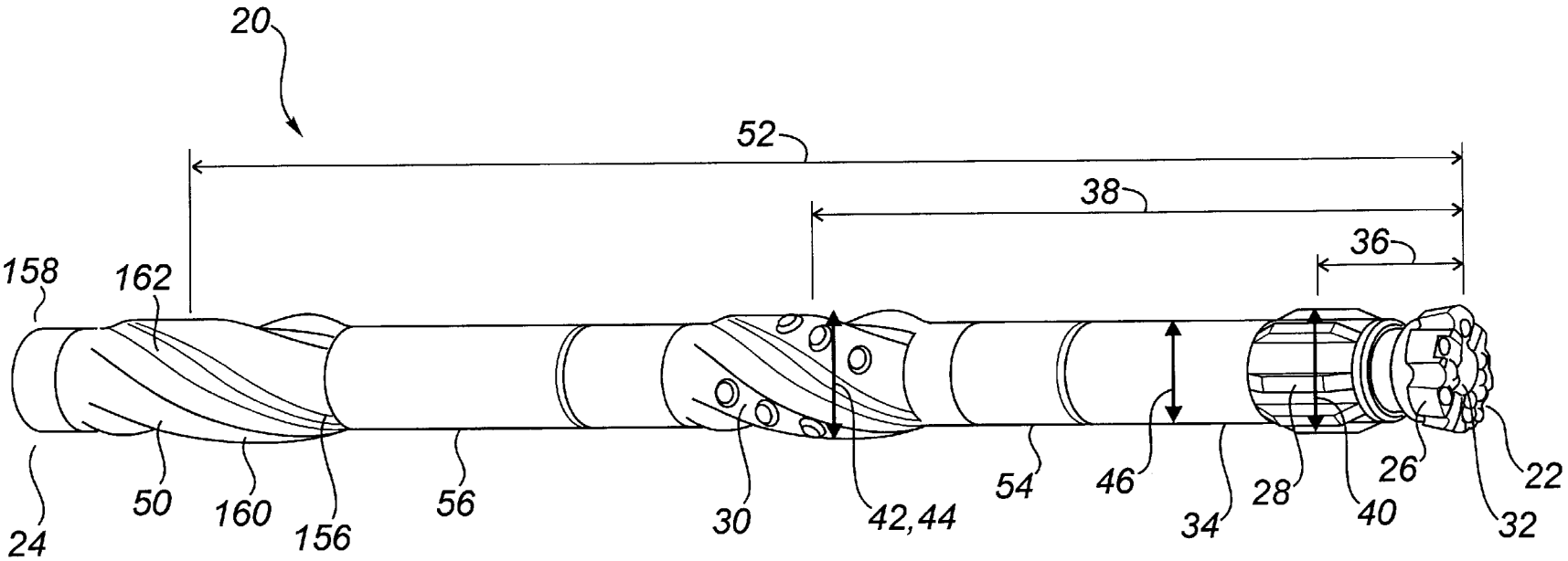
FIG. 1 is a side view of a pictorial representation of a preferred embodiment of a drilling assembly of the within invention.

Referring to FIG. 1, the present invention relates to a downhole drilling assembly (20), adapted to be positioned in a borehole, having a distal end (22) and a proximal end (24) for connection to a drill string. The drilling assembly (20) is comprised of a drilling bit (26) for drilling the borehole in the desired direction. The present invention also relates to a method for drilling a borehole with the use of a drilling assembly (20) positioned in the borehole.

The drilling assembly (20) and the drilling method are particularly for use in directional drilling in order to provide or facilitate control over the direction of the resulting borehole drilled by the drilling bit (26). Further, the drilling assembly (20) and method are preferably used when rotary drilling, in that the entire drill string is typically rotated by a rotary table located at the surface. However, the within drilling assembly (20) and method may also be used when sliding drilling, as described above.

The drilling assembly (20) permits the deviation or hole angle of the borehole to be adjusted while drilling in order to reach or be maintained within a desired subterranean formation. To achieve this purpose, the drilling assembly (20) is capable of producing an increase in the deviation angle of the borehole or producing a build angle or build section of the resulting borehole drilled by the drilling bit (26). Preferably, the drilling assembly (20) is also capable of producing a decrease in the deviation angle of the borehole or producing a drop angle or drop section for dropping the resulting borehole. In the preferred embodiment, the drilling assembly (20) is capable of selectively producing either a build section or a drop section, as desired by the user.

As stated, the drilling assembly (20) has a distal end (22) and a proximal end (24). The proximal end (24) is adapted for connection to the drill string, which drill string extends from the proximal end (24) of the drilling assembly (20) to the surface. As a result, the application of an axial or compressive force to the drill string results in the axial movement or sliding of the drilling assembly (20) through the borehole drilled by the drilling bit (26). In addition, when used for rotary drilling, the proximal end (24) of the drilling assembly (20) is adapted to be connected to the drill string in a manner such that rotation of the drill string from the surface causes a corresponding rotation of the drilling assembly (20), including the drilling bit (26), downhole.

The drilling assembly (20) is comprised of the drilling bit (26), a near bit stabilizer (28) and an adjustable gauge stabilizer (30). However, the drilling assembly (20) may be comprised of any number of further components such as one or more collars or one or more further stabilizers, as described below.

The drilling bit (26) has a distal end (32) which defines the distal end (22) of the drilling assembly (20). The distal end (32) of the drilling bit (26) is for contacting the ground or formation in order to drill the borehole therein. Further, the drilling bit (26) is supported in or by the drilling assembly (20) such that a bit drop angle is created between the drilling assembly (20) and the drilling bit (26).

The bit drop angle refers to the angle formed between a centre line or longitudinal axis of the drilling assembly (20) at the location of the near bit stabilizer (28) and a centre line or longitudinal axis of the drilling bit (26). The bit drop angle may be any angle, however, the bit drop angle must provide some degree of drop of the drilling bit (26) as compared to the near bit stabilizer (28). Further, the bit drop angle is selected to provide the desired result when drilling, as discussed in detail below. As well, preferably the drilling bit (26) is supported in a manner such that the magnitude of the bit drop angle is minimized, while still permitting the drilling of a drop section as described below.

The bit drop angle may be provided in any manner and by any structure, means or mechanism compatible with the intended drilling operations. However, preferably, the clearance between the adjacent supporting structure of the drilling assembly (20) and the drilling bit (26) are adjusted in order to provide the desired bit drop angle or desired amount of "play" between the adjacent structures. Thus, in the preferred embodiment, the clearance between the adjacent supporting structure of the drilling assembly (20) and the drilling bit (26) are minimized, while still providing some drop and while still permitting operation of the drilling bit (26) during drilling, in order to reduce the amount of "play" between the adjacent structures. In addition, the length of support of the drilling bit (26) may be adjusted in order to provide the desired bit drop angle. Specifically, the support length may be increased to decrease the bit drop angle.

Any drilling bit (26) capable of drilling the desired borehole and capable of providing the desired bit drop angle when supported by the drilling assembly (20) may be used. For instance, the drilling bit (26) may be comprised of a rotary drilling bit, where rate of penetration (ROP) is achieved by the shearing of material at the end of the borehole, or it may be comprised of a reciprocating hammer bit, where ROP is achieved by impacting the end of the borehole.

Where the drilling bit (26) is comprised of a rotary drilling bit, the rotary drilling bit may be connected to a rotary drill string such that rotation of the drill string causes rotation of the drilling bit. In this case, any rotary drilling bit may be used which is suitable for the specific desired drilling operation.

Alternately, the drilling assembly (20) may be further comprised of a downhole motor assembly (not shown) for rotating the rotary drilling bit. More particularly, the downhole motor assembly may be connected with the drill string as a component of the drilling assembly (20). Typical downhole motor assemblies comprise a downhole motor connected to a rotatable drive shaft which is driven thereby. During drilling operations, the downhole end of the rotatable drive shaft is connected to the rotary drilling bit so that the drilling bit can be driven and rotated by the downhole motor without rotation of the drill string. In this case, any motor assembly, and any rotary drilling bit compatible therewith may be used, which are suitable for the specific desired drilling operation.

However, preferably, the drilling bit (26) is comprised of a reciprocatable hammer bit. More particularly, the drilling bit (26) is comprised of a pneumatic hammer drilling bit. In this case, the drilling assembly (20) is further comprised of a reciprocating hammer (34), and preferably a pneumatic hammer, for driving the drilling bit (26) such that the drilling bit (26) is reciprocated thereby to impact the end of the borehole. Any reciprocating hammer (34), such as a pneumatic hammer, and any compatible reciprocatable drilling bit (26) may be used, which are suitable for the specific desired drilling operation.

Typically, pneumatic hammer or percussion drilling involves rotating the drilling bit (26) while it is reciprocating so that the impact elements of the drilling bit (26) do not repeatedly impact upon the same location at the end of the borehole. Where desired, rotation of the drilling bit (26) can be accomplished either by rotating the drilling bit (26) together with the drilling assembly (20) and the drill string, or by rotating the drilling bit (26) independently without rotating the drilling assembly (20) and the drill string.

The specific reciprocating hammer (34) and drilling bit (26) which comprise the drilling assembly (20) will thus be dependent upon the desired manner of rotating the drilling bit (26). For instance, as indicated above, the drilling bit (26), being a reciprocatable hammer bit in the preferred embodiment, may be adapted to rotate independently of the drilling assembly (20) as the drilling bit (26) reciprocates. For example, the hammer (34) which is drivingly connected to the drilling bit (26) may be adapted to reciprocate and rotate the drilling bit (26) concurrently.

The hammer (34) may include a mechanism or components which both reciprocate and rotate the attached drilling bit (26). For example, the hammer (34) may include a reciprocating piston (not shown) therein. The hammer (34), and in particular the piston, may be adapted such that the linear or axial motion of the reciprocating piston within the hammer (34) is converted into a rotational motion of the piston. The drilling bit (26) is connected or otherwise engaged with the piston of the hammer (34). As a result, reciprocation and rotation of the piston within the hammer (34) results in a corresponding reciprocation and rotation of the drilling bit (26), without rotating the hammer (34) or the other components of the drilling assembly (20) or the drill string.

Alternately, the hammer (34) may include a mechanism or components which the drilling bit (26) connected thereto, which are substantially separate and apart from the mechanism or components which reciprocate the drilling bit (26). For instance, a reciprocating piston may reciprocate the attached drilling bit (26), while at the same time, one or more rotatable blades or impellers, also pneumatically actuated, may act upon the drilling bit (26) resulting in the rotation of the drilling bit (26). Thus, again, reciprocation and rotation of the drilling bit (26) occurs without rotating the hammer (34) or the other components of the drilling assembly (20) or the drill string.

However, preferably, the drilling bit (26) is adapted to rotate with the drilling assembly (20) as the drilling bit (26) reciprocates. More particularly, in the preferred embodiment, the drilling assembly (20), including the hammer (34), is rotated during rotary drilling operations. Rotation of the hammer (34) results in the rotation of the drilling bit (26) which is connected or otherwise engaged therewith.

The near bit stabilizer (28) of the drilling assembly (20) is located a first axial distance (36) from the distal end (22) of the drilling assembly (20), being the distal end (32) of the drilling bit (26). The adjustable gauge stabilizer (30) is located a second axial distance (38) from the distal end (22) of the drilling assembly (20). The second axial distance (38) is greater than the first axial distance (36). In other words, the near bit stabilizer (28) is nearer to the distal end (32) of the drilling bit (26) than the adjustable gauge stabilizer (30). In addition, the first axial distance (36) is preferably selected such that the near bit stabilizer (28) is located near enough to the drilling bit (26) to provide stabilization to the drilling bit (26) during drilling operations. Thus, preferably, the first axial distance (36) is selected so that the near bit stabilizer (28) is located within close proximity to the drilling bit (26).

Further, the near bit stabilizer (28) has a near bit stabilizer gauge (40) which is defined by the maximum outer or outside diameter of the near bit stabilizer (28). The adjustable gauge stabilizer (30) is adjustable between extended and retracted positions and thus, has a gauge which is adjustable between an extended gauge (42) and a retracted gauge (44). The extended gauge (42) is defined by the maximum outer or outside diameter of the adjustable gauge stabilizer (30) when in its extended position. The retracted gauge (44) is defined by the maximum outer or outside diameter of the adjustable gauge stabilizer (30) when in its retracted position. Finally, the drilling assembly (20) has a nominal drilling assembly gauge (46) which is defined by the maximum outer or outside diameter of the drilling assembly (20) between the near bit stabilizer (28) and the adjustable gauge stabilizer (30).

In the preferred embodiment, the near bit stabilizer (28) provides a near bit stabilizer gauge (40) which is greater than the nominal drilling assembly gauge (46). In addition, the retracted gauge (44) of the adjustable gauge stabilizer (30) is less than the near bit stabilizer gauge (40).

Further, a stabilizer angle is created between the near bit stabilizer (28) and the adjustable gauge stabilizer (30). The stabilizer angle refers to the angle formed between a centre line or longitudinal axis of the near bit stabilizer (28) and a centre line or longitudinal axis of the adjustable gauge stabilizer (30). The magnitude of the stabilizer angle is variable depending upon a number of factors, including whether the adjustable gauge stabilizer (30) is adjusted to its retracted gauge (44) or its extended gauge (42). Further, the stabilizer angle is also dependent upon the magnitude of the near bit stabilizer gauge (40) and the magnitude of the retracted gauge (44) and extended gauge (42) of the adjustable gauge stabilizer (30). Finally, the stabilizer angle is dependent upon the magnitudes of the first and second axial distances (36, 38).

The stabilizer angle may be any angle, however, the stabilizer angle and the bit drop angle must be selected together to provide the desired result when drilling. Specifically, the combination of the bit drop angle and the stabilizer angle must result in, or be capable of providing, a net build angle of the drilling assembly (20) when the adjustable gauge stabilizer (30) is adjusted to the retracted gauge (44). In other words, when in the retracted gauge (44) position, the drilling assembly (20) will produce a build rate or a build section of the borehole during drilling operations.

Further, in the preferred embodiment, the stabilizer angle and the bit drop angle are also selected such that the combination of the bit drop angle and the stabilizer angle results in, or is capable of providing, a net drop angle of the drilling assembly (20) when the adjustable gauge stabilizer (30) is adjusted to the extended gauge (42). In other words, when in the extended gauge (42) position, the drilling assembly (20) will produce a drop rate or a drop section of the borehole during drilling operations.

Thus, in the preferred embodiment, the drilling assembly (20) is capable of providing either a build rate or a drop rate of the borehole as desired by selectively adjusting the adjustable gauge stabilizer (30) between the retracted gauge (44) and the extended gauge (42) respectively.

The near bit stabilizer (28) may be comprised of any structure or mechanism able to be positioned within the borehole in proximity to the drilling bit (26) which has one or more stabilizer elements and which is capable of contacting or engaging the wall of the borehole in a manner such that the drilling bit (26) is stabilized thereby during drilling operations. In this regard, any stabilizer, and in particular any near bit stabilizer, may be used. For instance, the near bit stabilizer (28) may be any rotating stabilizer, incorporated into the drilling assembly (20) to either rotate or slide with the drill string, or any non-rotating sleeve stabilizer, incorporated into the drilling assembly (20) such that the sleeve and the stabilizer elements do not rotate with the drill string. In addition, the near bit stabilizer gauge (40) may be adjustable or fixed. Preferably, the near bit stabilizer (28) is comprised of a rotating stabilizer, incorporated into the drilling assembly (20) to rotate and slide with the drill string, having a fixed or non-adjustable near bit stabilizer gauge (40).

The adjustable gauge stabilizer (30) may be comprised of any structure or mechanism able to be positioned within the borehole which has one or more stabilizer elements movable radially such that the gauge is adjustable between a retracted gauge (44) and an extended gauge (42), which permits drilling when adjusted to either the retracted or extended gauges (44, 42) and which is capable of contacting or engaging the wall of the borehole in a manner such that the drilling assembly (20) is stabilized thereby when adjusted to the extended gauge (42). In this regard, any adjustable gauge stabilizer may be used.

For instance, the adjustable gauge stabilizer (30) may be any adjustable rotating stabilizer, incorporated into the drilling assembly (20) to either rotate or slide with the drill string, or any adjustable non-rotating sleeve stabilizer, incorporated into the drilling assembly (20) such that the sleeve and the stabilizer elements do not rotate with the drill string. Further, the adjustable gauge stabilizer (30) may be actuated in any manner, such as pneumatically or mechanically. However, preferably, the adjustable gauge stabilizer (30) is a pneumatically actuated rotating stabilizer incorporated into the drilling assembly (20) such that the adjustable gauge stabilizer (30) rotates upon rotation of the drilling assembly (20) through rotation of the drill string.

Further, the adjustable gauge stabilizer (30) may be adjustable between the extended and retracted positions, to provide the extended and retracted gauges (42, 44), in any manner. For instance, in the preferred embodiment, the adjustable gauge stabilizer (30) is adjustable between at least a fully extended gauge (42) and a fully retracted gauge (44). As described further below. However, the adjustable gauge stabilizer (30) may also be adjustable to an infinite number of positions between a fully retracted position and a fully extended position. In other words, the stabilizer (30) may provide for varying degrees of extension or retraction. In this case, the extended and retracted gauges (42, 44) are defined at selected extended and retracted positions of the stabilizer (30).

In any configuration of the drilling assembly (20) of the within invention, some amount of deflection of the drilling assembly (20) above the near bit stabilizer (28) will occur relative to the longitudinal axis of the drilling assembly (20) during drilling operations when the adjustable gauge stabilizer (30) is adjusted between the extended gauge (42) and the retracted gauge (44), and this deflection is necessary for the practice of the invention. The actual amount of deflection that is experienced by the drilling assembly (20) will depend upon numerous factors, including the unsupported length of the drilling assembly (20) above the near bit stabilizer (28), the diameter and stiffness of the components of the drilling assembly (20) above the near bit stabilizer and the magnitude and direction of any forces which are acting on the drilling assembly (20).

For instance, in the preferred embodiment, as described further below, the drilling assembly (20) further includes a string stabilizer (50) for further stabilizing the drilling assembly (20) and the attached drill string in the borehole during drilling operations. The string stabilizer (50) is located a third axial distance (52) from the distal end (22) of the drilling assembly (20), which is greater than the second axial distance (38). In this instance, the deflection referred to above will occur along the drilling assembly (20) between the near bit stabilizer (28) and the string stabilizer (50).

Any amount of deflection of the drilling assembly (20) in response to adjustment of the adjustable gauge stabilizer (30) between the extended gauge (42) and the retracted gauge (44) will be sufficient for the purposes of the invention as long as adjustment of the adjustable gauge stabilizer (30) between the extended gauge (42) and the retracted gauge (44) can result in the formation of the net build angle and the net drop angle.

In the preferred embodiment, however, the specific location of the adjustable gauge stabilizer (30) along the length of the drilling assembly (20) is preferably chosen so that the drilling assembly (20) adjacent to the adjustable gauge stabilizer (30) will deflect as the adjustable gauge stabilizer (30) is adjusted between the extended gauge (42) and the retracted gauge (44) by an amount which is approximately coincidental with the difference in the radius of the adjustable gauge stabilizer (30) between the extended gauge (42) and the retracted gauge (44). For example, if the difference in the radius of the adjustable gauge stabilizer (30) between the extended gauge (42) and the retracted gauge (44) is one-quarter inch, the drilling assembly (20) adjacent to the adjustable gauge stabilizer (30) will preferably deflect approximately one-quarter inch in response to adjustment of the adjustable gauge stabilizer between the extended gauge (42) and the retracted gauge (44).

Thus, in the preferred embodiment, the first axial distance (36), the second axial distance (38) and the third axial distance (52) may have any magnitude compatible with, and suitable for, the manner of operation of the drilling assembly (20) as described above. However regardless of the specific distances selected, the second axial distance (38) is greater than the first axial distance (36) and the third axial distance (52) is greater than the second axial distance (38). Where necessary, each of these distances may be adjusted using any structure or mechanism capable of varying the length of the drilling assembly (20).

For instance, one or more collars may be inserted between the near bit stabilizer (28) and the adjustable gauge stabilizer (30) and between the adjustable gauge stabilizer (30) and the string stabilizer (50). Thus, the second axial distance (38) may be adjusted by changing the length of a first collar (54) or the number of first collars (54) between the near bit stabilizer (28) and the adjustable gauge stabilizer (30). Similarly, the third axial distance (52) may be adjusted by changing the length of a second collar (56) or the number of second collars (56) between the adjustable gauge stabilizer (30) and the string stabilizer (50).

The string stabilizer (50) may be comprised of any structure or mechanism able to be positioned within the borehole which has one or more stabilizer elements and which is capable of contacting or engaging the wall of the borehole in a manner such that the drilling assembly (20) is stabilized thereby during drilling operations. In this regard, any stabilizer may be used. For instance, the string stabilizer (50) may be any rotating stabilizer, incorporated into the drilling assembly (20) to either rotate or slide with the drill string, or any non-rotating sleeve stabilizer, incorporated into the drilling assembly (20) such that the sleeve and the stabilizer elements do not rotate with the drill string. In addition, the gauge of the string stabilizer (50) may be adjustable or fixed. Preferably, the string stabilizer (50) is comprised of a rotating stabilizer, incorporated into the drilling assembly (20) to rotate and slide with the drill string, having a fixed or non-adjustable gauge.

Referring to FIG. 1, in the preferred embodiment, starting downhole at the distal end (22) of the drilling assembly (20) and moving in an uphole direction, the drilling assembly (20) is comprised of the drilling bit (26), the near bit stabilizer (28), the pneumatic hammer (34), the first collar (54), the adjustable gauge stabilizer (30), the second collar (56) and the string stabilizer (50). Each of these sections or components may be connected with the adjacent sections or components in any suitable manner permitting the operation of the drilling assembly (20), such as by threaded or splined connections. However, one or more components or sections of the drilling assembly (20) may also be integrally formed to comprise a single unit.

In the preferred embodiment, referring to FIGS. 1–5, the drilling bit (26) is a reciprocatable hammer bit, which is actuated by a pneumatic hammer (34). Specifically, the hammer (34) acts upon and drives the drilling bit (26) such that the drilling bit (26) is reciprocated in order to repeatedly impact the end of the borehole. Further, the drilling bit (26) is engaged with or connected to the hammer (34) such that the drilling bit (26) rotates with the hammer (34). As well, the hammer (34) is engaged or connected with the other components of the drilling assembly (20) such that the hammer (34) rotates with the entire drilling assembly (20). Thus, during drilling operations, the drilling bit (26) reciprocates. At the same time, the drilling assembly (20), including the hammer (34) and drilling bit (26), is rotated so that the impact elements of the drilling bit (26) do not repeatedly impact upon the same location at the end of the borehole. In other words, rotation of the drilling bit (26) is preferably accomplished by rotating the drilling bit (26) together with the drilling assembly (20) and the drill string.

Figure 2A:
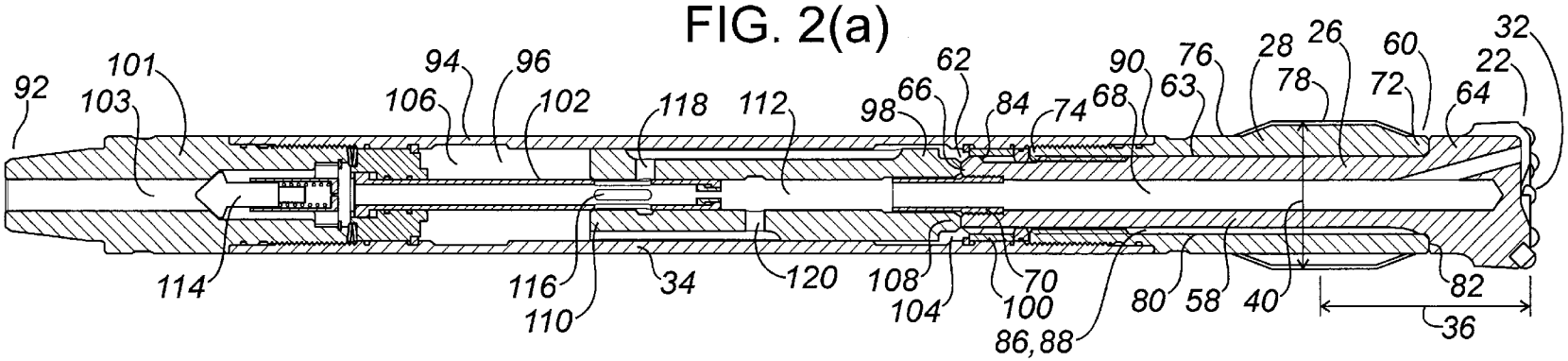
FIGS. 2(*a*) and 2(*b*) are longitudinal sectional views of a drilling bit, a near bit stabilizer and a pneumatic hammer comprising the drilling assembly, wherein the drilling bit is shown in a retracted position and an extended position respectively.
Figure 2B:
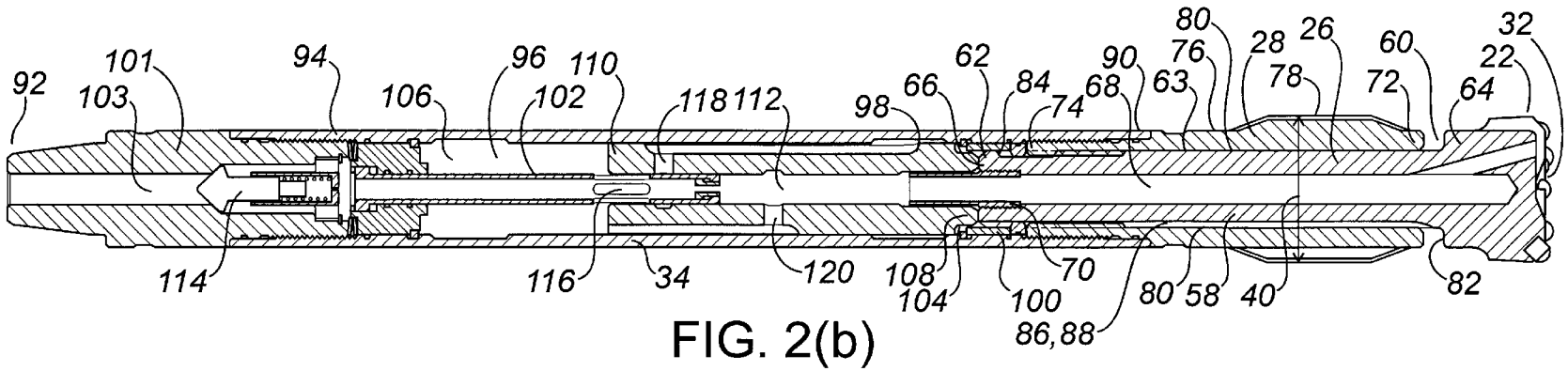
Figure 3A:
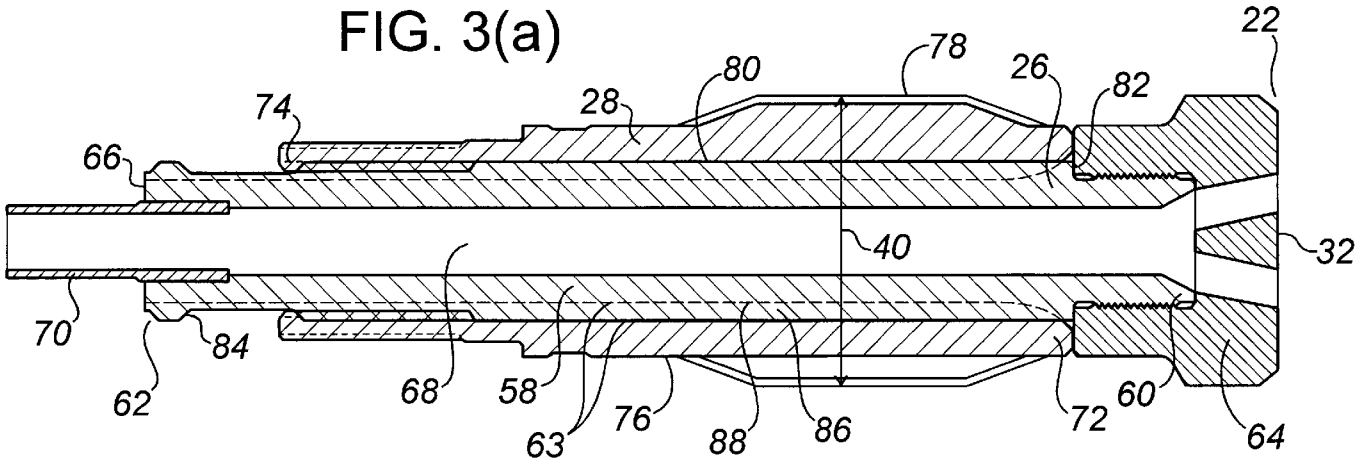
FIGS. 3(*a*) and 3(*b*) are longitudinal sectional views of a variant of the drilling bit and the near bit stabilizer as shown in FIGS. 2(*a*) and 2(*b*) respectively.
Figure 3B:
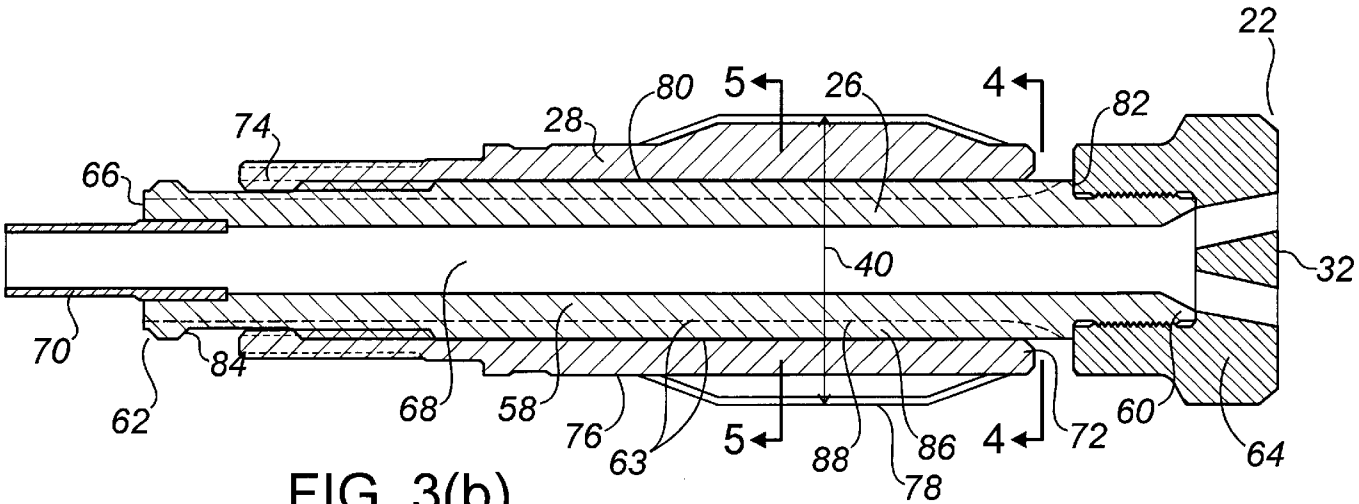

The drilling bit (26), being a hammer bit in the preferred embodiment, is comprised of an elongated bit shaft (58), having a distal end (60), a proximal end (62) and an outer surface (63). The distal end (60) includes an enlarged impact head (64) for impacting the end of the borehole. The distal end (32) of the drilling bit (26), and in particular the impact head (64), define the distal end (22) of the drilling assembly (20). The impact head (64) may be fixedly or removably connected or attached with the distal end (60) in any manner and by any connector mechanism or structure. For instance, the impact head (64) may be threadably connected to the distal end (60) of the bit shaft (58), as shown in FIG. 3(*a*) and (*b*), or it may be integrally formed therewith, as shown in FIGS. 2(*a*) and (*b*). The proximal end (62) of the bit shaft (58) defines an anvil end face (66) for engagement by the hammer (35), as described below, such that the hammer (34) reciprocates the bit shaft (58) and the impact head (64) connected therewith.

Further, the bit shaft (58) defines a bore (68) extending therethrough between the proximal and distal ends (62, 60) to provide an exhaust passage for the hammer (34). More particularly, the bore (68) of the bit shaft (58) communicates with, and is connected to, the hammer (34) by a bit nozzle (70) extending therebetween. The bit nozzle (70) may be fixedly or removably connected or attached with the proximal end (62) in any manner and by any connector mechanism or structure. For instance, the bit nozzle (70) may be integrally formed with the proximal end (62) or it may be attached by a threaded or welded connection.

As stated, in the preferred embodiment, the near bit stabilizer (28) is comprised of a rotating stabilizer, incorporated into the drilling assembly (20) to rotate and slide with the drill string. The near bit stabilizer (28) has a distal end (72), a proximal end (74) and an outer surface (76). One or more stabilizing elements (78) are associated with the outer surface (76) for engagement or contact with the wall of the borehole. The stabilizing elements (78) may be associated with the outer surface (76) in any manner. However, preferably, the stabilizing elements are fixedly mounted to, or integrally formed with, the outer surface (76) such that the stabilizing elements (78) rotate therewith. In addition, the stabilizing elements (78) are preferably fixed so that the near bit stabilizer (28) has a fixed or non-adjustable near bit stabilizer gauge (40), which is defined by the maximum outer or outside diameter of the near bit stabilizer (28) including its stabilizing elements (78).

Any number or type of stabilizing elements (78) may be used which are suitable for the specific drilling operation. However, in the preferred embodiment, the near bit stabilizer (28) is comprised of four straight stabilizing blades equidistantly spaced about the outer surface (76) of the stabilizer (28).

As discussed previously, the near bit stabilizer (28) is located a first axial distance (36) from the distal end (22) of the drilling assembly (20), being the distal end (32) of the drilling bit (26). The first axial distance (36) may be measured as the distance between distal end (32) of the drilling bit (26) and any selected point along the length of the near bit stabilizer (28). However, preferably, the first axial distance (36) is measured between the distal end (32) of the drilling bit (26) and a point on the near bit stabilizer (28) defined by a longitudinal mid-point of the stabilizing elements (78) of the near bit stabilizer (28) as shown in FIG. 1.

Further, the near bit stabilizer (28) defines a bore (80) extending therethrough between its distal and proximal ends (72, 74). The bit shaft (58) of the drilling bit (26) is adapted to be reciprocatably or slidably mounted within the bore (80) of the near bit stabilizer (28) such that the impact head (64) of the bit shaft (58) extends from the distal end (72) of the near bit stabilizer (28) and the proximal end (62) of the bit shaft (58) extends from the proximal end (74) of the near bit stabilizer (28).

As shown in FIGS. 3(*a*) and (*b*), reciprocation of the bit shaft (58) upward or in an uphole direction is limited by the engagement of the distal end (72) of the near bit stabilizer (28) with an upwardly facing shoulder (82) defined by the impact head (64). Reciprocation of the bit shaft (58) downward or in a downhole direction is limited by the engagement of a downwardly facing shoulder (84) defined by the proximal end (62) of the bit shaft (58) with the proximal end (74) of the near bit stabilizer (28).

Further, the bore (80) of the near bit stabilizer (28) is compatible with the outer surface (63) of the bit shaft (58) of the drilling bit (26) such that the bit shaft (58) may reciprocate therein and such that rotation of the near bit stabilizer (28) results in rotation of the bit shaft (58). Any structure or mechanism capable of providing this compatibility between the bore (80) of the near bit stabilizer (28) and the outer surface (63) of the bit shaft (58) may be used. However, as particularly shown in FIGS. 4 and 5, in the preferred embodiment, a splined connection is provided between the bore (80) of the near bit stabilizer (28) and the outer surface (63) of the bit shaft (58). More particularly, the bore (80) of the near bit stabilizer (28) defines a plurality of equidistantly spaced, longitudinally extending, parallel splines (86) which are compatible and interlocking with a plurality of equidistantly spaced, longitudinally extending, parallel splines (88) defined by the outer surface (63) of the bit shaft (58).

In addition, as described above, the drilling bit (26) is supported by the drilling assembly (20) such that the bit drop angle is created between the drilling assembly (20) and the drilling bit (26). In the preferred embodiment, the bit shaft (58) of the drilling bit (26) is supported by the bore (80) of the near bit stabilizer (28) in the manner described above during reciprocation of the bit shaft (58) therein. As a result, in the preferred embodiment, the bit drop angle refers specifically to the angle formed between a centre line or longitudinal axis of the near bit stabilizer (28) and a centre line or longitudinal axis of the bit shaft (58).

In order to achieve the desired bit drop angle, either or both of the clearance between the adjacent surfaces of the bit shaft (58) and the near bit stabilizer (28) and the length of the bit shaft (58) may be varied. More particularly, the clearance between the adjacent outer surface (63) of the bit shaft (58) and the bore (80) of the near bit stabilizer (28) may be reduced in order to reduce the amount of "play" therebetween and thus decrease the bit drop angle. In addition, the length of the bit shaft (58) supported within the bore (80) of the near bit stabilizer (28) may be increased in order to decrease the bit drop angle.

Referring to FIGS. 2(*a*) and (*b*), the hammer (34) of the drilling assembly (20) has a distal end (90) and a proximal end (92) and is comprised of a housing (94), defining a piston chamber (96), and a reciprocatable piston (98) contained within the piston chamber (96). The piston chamber has a distal end (104) and a proximal end (106). Similarly, the piston (98) has a distal end (108) and a proximal end (110). In addition, the piston (98) defines a bore (112) extending therethrough between the proximal and distal ends (110, 108).

The distal end (90) of the hammer (34) is connect, attached or otherwise engaged with the proximal end (74) of the near bit stabilizer (28), while the proximal end (92) of the hammer (34) is connected, attached or otherwise engaged with the other components of the drilling assembly (20) as described below. The distal and proximal ends (90, 92) of the hammer (34) are adapted for connection therewith in a manner such that the drilling assembly (20) is rotatable as a unit upon rotation of the attached drill string. Thus, rotation of the hammer (34) rotates the near bit stabilizer (28), which in turn, rotates the drilling bit (26).

More particularly, the distal end (90) of the hammer (34), and in particular the housing (94), is connected or attached with the proximal end (74) of the near bit stabilizer (28) such that the proximal end (62) of the bit shaft (58) extends from the proximal end (74) of the near bit stabilizer into the distal end (90) of the housing (94). The distal end (90) of the hammer housing (94) may be fixedly or removably connected or attached with proximal end (74) of the near bit stabilizer (28) in any manner and by any connector mechanism or structure. For instance, the near bit stabilizer (28) may be integrally formed with the hammer (34) or their respective ends (74, 90) may be attached by a threaded or welded connection. In addition, the proximal end (62) of the bit shaft (58) may be supported and retained in the distal end (90) of the hammer (34) in any manner and by any supporting and retaining structure or mechanism. For instance, a bit bearing (100) is preferably located between the adjacent surfaces of the proximal end (62) of the bit shaft (58) and the distal end (90) of the hammer (34).

Further, the proximal end (62) of the bit shaft (58) is adapted to be supported in the distal end (90) of the hammer (34) so that the piston (98) of the hammer (34) can be pneumatically reciprocated in the piston chamber (96) for engagement with the anvil end face (66) of the bit shaft (58). Further, the bore (68) of the bit shaft (58) communicates and is connected with the bore (112) of the piston (98) by the bit nozzle (70) extending therebetween.

Finally, the proximal end (92) of the hammer (34) is comprised of a backhead (101) which provides a connection between the housing (94) of the hammer (34) and the other components of the drilling assembly (20). The backhead (101) also defines a bore (103) extending therethrough which communicates and is connected with the piston chamber (96). The housing (94) may be fixedly or removably connected or attached with the backhead (101) in any manner and by any connector mechanism or structure. For instance, the housing (94) may be integrally formed with the backhead (101) or they may be attached by a threaded or welded connection.

Pneumatic fluid under pressure is conducted by the drill string to the hammer (34) for pneumatic reciprocation of the piston (98). Any pneumatic pressure fluid may be used, such as a fluid comprised of a compressed gas or air. A fluid feed tube (102) is coaxially mounted within the proximal end (106) of the chamber (96) for supplying the pneumatic fluid. During drilling, the pneumatic fluid is supplied to the feed tube (102) by a check valve (114). The check valve (114) is contained, at least in part, within the bore (103) of the backhead(101) of the hammer (34). The feed tube (102) extends from the check valve (114) into the piston (98) such that it may conduct pneumatic fluid from the bore (103) of the backhead (101) to the bore (112) of the piston (98).

To reciprocate the piston (98), opposite ends (106, 108) of the piston chamber (96) are sequentially connected to exhaust and to receive fluid from the feed tube (102).

Specifically, as the piston (98) reciprocates, the proximal end (106) of the chamber (96) is first sequentially connected to exhaust, while pneumatic fluid is supplied to the distal end (104) of the chamber (96) to move the piston (98) upward or in an uphole direction. The distal end (104) of the chamber (96) is then sequentially connected to exhaust, while pneumatic fluid is supplied to the proximal end (106) of the chamber (96) to move the piston (98) downward or in a downhole direction to impact the drilling bit (26). The exhaust connection to the distal end (104) of the chamber (96) is provided by the bit nozzle (70).

Further, pneumatic fluid is supplied from the feed tube (102) through one or more ports (116) defined therein. Fluid is supplied through the ports (116) to the distal end (104) of the chamber (96) by one or more first radially extending bores (118) drilled in the piston (98) which communicate with the distal end (104). Similarly, fluid is supplied through the ports (116) to the proximal end (106) of the chamber (96) by one or more second radially extending bores (120) drilled in the piston (98) which communicate with the proximal end (106).

Figure 6A:
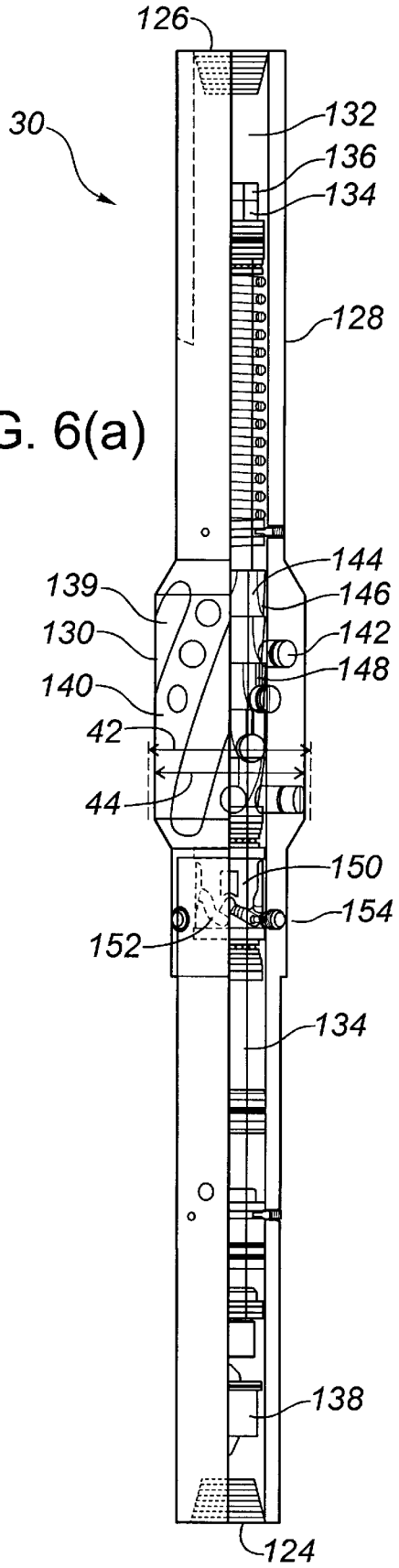
FIGS. 6(*a*) and 6(*b*) are side views of a pictorial representation of an adjustable gauge stabilizer comprising the drilling assembly, wherein FIG. 6(*b*) shows details of a mandrel inserted within a bore of the adjustable gauge stabilizer.
Figure 6B:
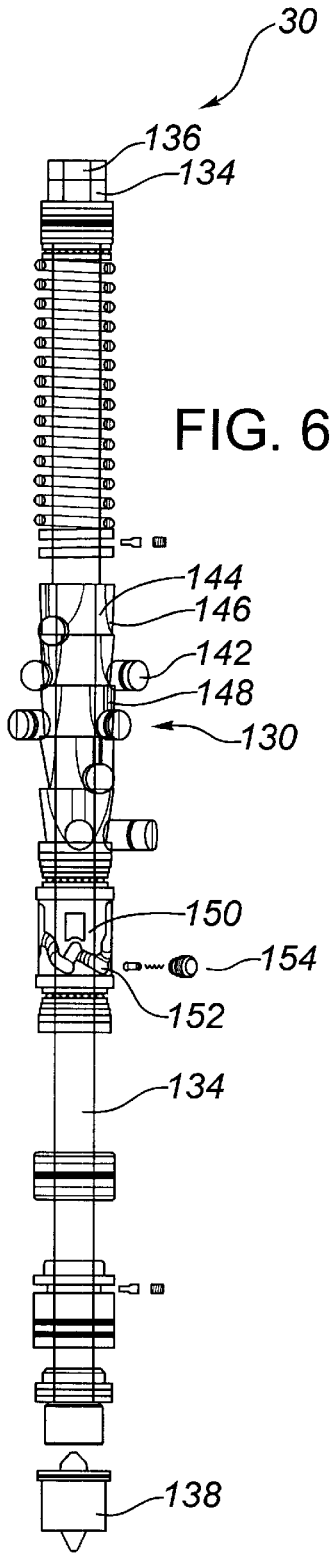

Referring to FIGS. 6(*a*) and (*b*), preferably, the adjustable gauge stabilizer (30) is a pneumatically actuated rotating stabilizer incorporated into the drilling assembly (20) above the hammer (34) such that the adjustable gauge stabilizer (30) rotates upon rotation of the drilling assembly (20) through rotation of the drill string. Although any pneumatic adjustable gauge stabilizer may be used, the adjustable gauge stabilizer (30) is preferably an adjustable gauge rotating blade type stabilizer known as the Sperry-Sun AGS (TM), which is manufactured by Sperry-Sun Drilling Services, a division of Dresser Industries, Inc.

In the preferred embodiment, the adjustable gauge stabilizer (30) has a distal end (124), a proximal end (126) and an outer surface (128). One or more adjustable stabilizing elements (130) or blades are associated with the outer surface (128). The adjustable stabilizing elements (130) may be associated with the outer surface (128) in any manner permitting the adjustment of the stabilizing elements (130) between a retracted and an extended position to define the retracted gauge (44) and the extended gauge (42) of the adjustable gauge stabilizer (30). The retracted gauge (44) is defined by the maximum outer or outside diameter of the adjustable gauge stabilizer (30) when the stabilizing elements (130) are in a fully retracted position away from the wall of the adjacent borehole. The extended gauge (42) is defined by the maximum outer or outside diameter of the adjustable gauge stabilizer (30) when the stabilizing elements (130) are in a fully extended position towards the wall of the adjacent borehole. Further, preferably, the adjustable stabilizing elements (130) are also fixedly mounted to, or integrally formed with, the outer surface (128) such that the stabilizing elements (130) rotate therewith.

The distal end (124) of the adjustable gauge stabilizer (30) may be directly attached or connected to the proximal end (92) of the hammer (34). Alternately, one or more first collars (54) may be connected or attached between the distal end (124) of the adjustable gauge stabilizer (30) and the proximal end (92) of the hammer (34). The number and length of the first collar or collars (54) may vary to provide the desired second axial distance (38). In any event, the adjacent ends may be fixedly or removably connected or attached together in any manner and by any connector mechanism or structure. For instance, the adjacent ends may be attached by a threaded or welded connection. The proximal end (126) of the adjustable gauge stabilizer (30) is similarly adapted for connection with the other components of the drilling assembly (20).

As discussed previously, the adjustable gauge stabilizer (30) is located a second axial distance (38) from the distal end (22) of the drilling assembly (20), being the distal end (32) of the drilling bit (26). The second axial distance (38) may be measured as the distance between distal end (32) of the drilling bit (26) and any selected point along the length of the adjustable gauge stabilizer (30). However, preferably, the second axial distance (38) is measured between the distal end (32) of the drilling bit (26) and a point on the adjustable gauge stabilizer (30) defined by a longitudinal mid-point of the stabilizing elements (130) of the adjustable gauge stabilizer (30).

The specific location of the adjustable gauge stabilizer (30) along the length of the drilling assembly (20) is dependent upon the amount of deflection of the drilling assembly (20) which can be expected to occur when the adjustable gauge stabilizer (30) is adjusted between the extended gauge (42) and the retracted gauge (44), as described above. More particularly, in the preferred embodiment, the second axial distance (38) is preferably selected so that the drilling assembly (20) adjacent to the adjustable gauge stabilizer (30) deflects by an amount which is approximately coincidental with the difference in the radius of the adjustable gauge stabilizer (30) between the extended gauge (42) and the retracted gauge (44).

As discussed above, the stabilizer angle is created between a centre line or longitudinal axis of the near bit stabilizer (28) and a centre line or longitudinal axis of the adjustable gauge stabilizer (30). The stabilizer angle and the bit drop angle are selected such that the combination of the bit drop angle and the stabilizer angle results in a net build angle of the drilling assembly (20) when the adjustable gauge stabilizer (30) is adjusted to the retracted gauge (44). Thus, when in the retracted gauge (44) position, the drilling assembly (20) produces a build rate or build section of the borehole during drilling operations. Further, the stabilizer angle and the bit drop angle are also preferably selected such that the combination of the bit drop angle and the stabilizer angle results in a net drop angle of the drilling assembly (20) when the adjustable gauge stabilizer (30) is adjusted to the extended gauge (42). Thus, when in the extended gauge (42) position, the drilling assembly (20) will produce a drop rate or a drop section of the borehole during drilling operations.

The stabilizing elements (130) of the adjustable gauge stabilizer (30) may be adjusted between the extended and retracted gauges (42, 44) in any manner and by any structure or mechanism capable of providing the desired adjustment. However, in the preferred embodiment, the adjustable gauge stabilizer (30) defines a bore (132) extending therethrough between its distal and proximal ends (124, 126). The stabilizing elements (130) are radially adjustable and are actuated by axial movement of a mandrel (134) contained within the bore (132) of the stabilizer (30). The mandrel (134) has an proximal end (136) and a distal end (138), and includes a number of tubular sections connected together with threaded connections. The mandrel (134) is capable of limited axial movement within the bore (132) of the adjustable gauge stabilizer (30) in order to actuate the stabilizing elements (130).

The adjustable gauge stabilizer (30) may be provided with any number and type of adjustable stabilizing elements (130). In the preferred embodiment, the adjustable stabilizing elements (130) are comprised of a piston housing (139), defining three longitudinally extending, equidistantly spaced straight or spiral blades (140), and a plurality of pistons (142) associated with the blades (140). Each piston (142) has an inner radial surface and an outer radial surface and extends through the piston housing (139). The inner radial surface of each piston (142) extends through an inner surface of the piston housing (139) to interface with the mandrel, while the outer radial surface of each piston (142) extends through an outer surface of the piston housing (139) at the location of the associated blade (140).

In the preferred embodiment, the pistons (142) are capable of radial movement relative to the mandrel (134) between a number of different positions, including a retracted position and an extended position. In the retracted position, the outer radial surfaces of the pistons (142) are flush with the exterior or outer surface of the piston housing (139). In the extended position, the outer radial surfaces of the pistons (142) protrude outward from the exterior or outer surface of the piston housing (139). The pistons (142) are also preferably capable of movement into a rest position in which the outer radial surfaces of the pistons (142) are withdrawn slightly inside the exterior or outer surface of the piston housing (139).

The radial position of the adjustable gauge stabilizer (30) is determined by a stabilizer actuator which is associated with the mandrel (134) and which causes radial movement of the stabilizer (30) in response to axial movement of the mandrel (134) as a result of a differential pressure between the downhole pressure of the borehole adjacent the drilling assembly (20) and the pressure of the circulating fluid passing through the drilling assembly (20), and in particular the adjustable gauge stabilizer (30). In the preferred embodiment the stabilizer actuator comprises a set of ramp rings (144) having ramped outer surfaces (146) which engage the inner radial surfaces of the pistons (142). The ramp rings (144) are tubular collars which are mounted on the mandrel (134) adjacent the piston housing (139) such that the ramp rings (144) move axially with the mandrel (134).

The ramped outer surfaces (146) of the ramp rings (144) engage the inner radial surfaces of the pistons (142) and are arranged so that their ramped outer surfaces (146) increase in radial dimension in a direction toward the proximal end (136) of the mandrel (134) so that the pistons (142) are moved radially outward in response to movement of the mandrel (134) toward the distal end (124) of the adjustable gauge stabilizer (30). The pistons (142) are maintained in engagement with the ramp rings (144) by tracks (148) on the outer ramped surfaces (146) of the ramp rings (144) which engage complementary grooves in the inner radial surfaces of the pistons (142). The pistons (142) slide along the grooves in response to axial movement of the mandrel (134).

In the preferred embodiment, the piston housing (139) defines three blades (140) spaced circumferentially around the piston housing (139). Each blade (140) includes a set of pistons (142) spaced axially along the piston housing (139). In the preferred embodiment, each set of pistons (142) includes four pistons so that the stabilizer (30) therefore includes twelve pistons (142) spaced circumferentially and axially on the piston housing (139).

In the preferred embodiment, the stabilizer actuator includes four ramp rings (144) so that a separate ramp ring (144) actuates each piston (142) in a set of pistons (142). In addition, each ramp ring (144) actuates one piston (142) associated with each of the blades (140) so that three pistons (142) are therefore actuated by each ramp ring (144), and each of the twelve pistons (142) making up the stabilizer (30) extends and retracts the same radial distance in response to axial movement of the mandrel (134).

However, any number, configuration and shape of stabilizer elements, pistons (142) and ramp rings (144) may however be used in the adjustable gauge stabilizer (30). Further, the pistons (142) may also be designed to extend and retract unequal distances in response to axial movement of the mandrel (134). As well, although the pistons (142) in the preferred embodiment are round, they may also be elongated or may be any other shape and a set of pistons (142) may include only one piston (142). The stabilizer blades (140) may also be of any suitable shape or configuration.

Further, an indexing mechanism is provided to facilitate movement of the stabilizer (30) between the various positions. In the preferred embodiment, the adjustable gauge stabilizer (30) may be moved between the retracted position, the extended position and the rest position. A tubular barrel cam (150) is rotatably mounted on the mandrel (134) adjacent a lower or more distal end of the ramp rings (144). The barrel cam includes a continuous groove (152) around its external circumference. A first position in the groove (152) corresponds to a first maximum downward position of the mandrel (134) in which the adjustable gauge stabilizer (30) is in the retracted position. A second position in the groove (152) corresponds to a second maximum downward position of the mandrel (134) in which the adjustable gauge stabilizer (30) is in the extended position. A third position in the groove (152) corresponds to a maximum upward position of the mandrel (134) in which the adjustable gauge stabilizer (30) is in the rest position. There are two locations in the groove (152) corresponding to each of the first position, the second position and the third position, with the two locations being separated by 180°. The groove (152) varies in depth about the circumference of the barrel cam (150).

Further, the piston housing (139) includes a pair of barrel cam bushings (154) which are separated by 180°. These barrel cam bushings (154) protrude adjacent to the barrel cam (150). At least one of these barrel cam bushings (154) is equipped with a barrel cam pin which also protrudes for engagement with the groove (152) in the barrel cam (150). The barrel cam pin is spring loaded so that it is urged toward the groove (152) and is capable of limited radial movement in order to enable it to move in the groove (152) about the entire circumference of the barrel cam (150) as the barrel cam (150) rotates relative to the mandrel (134).

The variable depth groove (152) in the barrel cam (150) includes steps along its length so that the barrel cam pin can move only in one direction in the groove (152) and will be prevented from moving in the other direction due to the combined effects of the spring loading of the barrel cam pin and the steps in the groove (152). The groove (152) is configured so that the barrel cam pin will move in sequence in the groove (152) to the first position, the third position, the second position, the third position, the first position, the third position, the second position, the third position and so on. In other words, the stabilizer (30) always moves through the rest position between movements from the retracted position to the extended position or vice versa.

Other types and configurations of indexing mechanisms may be utilized in the adjustable gauge stabilizer (30), provided that they perform the function of regulating axial movement of the mandrel (134) relative to the bore (132) of the adjustable gauge stabilizer (30).

Finally, in the preferred embodiment, the drilling assembly (20) is further comprised of the string stabilizer (50) for further stabilizing the drilling assembly (20) and the attached drill string in the borehole during drilling operations. Preferably, the string stabilizer (50) is comprised of a rotating stabilizer, incorporated into the drilling assembly (20) to rotate and slide with the drill string. The string stabilizer (50) has a distal end (156), a proximal end (158) and an outer surface (160). One or more stabilizing elements (162) are associated with the outer surface (160) for engagement or contact with the wall of the borehole. The stabilizing elements (162) may be associated with the outer surface (160) in any manner. However, preferably, the stabilizing elements (162) are fixedly mounted to, or integrally formed with, the outer surface (160) such that the stabilizing elements (162) rotate therewith. In addition, the stabilizing elements (162) are fixedly mounted such that the string stabilizer (50) has a fixed or non-adjustable string stabilizer gauge, which is defined by the maximum outer or outside diameter of the string stabilizer (50) including its stabilizing elements (162).

Any number or type of stabilizing elements (162) may be used which are suitable for the specific drilling operation. However, in the preferred embodiment, the string stabilizer (50) is comprised of four straight or spiraling stabilizing blades equidistantly spaced about the outer surface (160) of the string stabilizer (50).

The string stabilizer (50) is preferably attached or connected to the adjustable gauge stabilizer (30) by one or more second collars (56). Specifically, the second collar (56) is connected or attached between the distal end (156) of the string stabilizer (50) and the proximal end (74) of the adjustable gauge stabilizer (30). The number and length of the second collar or collars (56) may vary to provide the desired third axial distance (52). In any event, the adjacent ends may be fixedly or removably connected or attached together in any manner and by any connector mechanism or structure. For instance, the adjacent ends may be attached by a threaded or welded connection. The proximal end (158) of the string stabilizer (50) is similarly adapted for connection with the drill string.

As discussed previously, the string stabilizer (50) is located the third axial distance (52) from the distal end (22) of the drilling assembly (20), being the distal end (32) of the drilling bit (26). The third axial distance (52) may be measured as the distance between distal end (32) of the drilling bit (26) and any selected point along the length of the string stabilizer (50). However, preferably, the third axial distance (52) is measured between the distal end (32) of the drilling bit (26) and a point on the string stabilizer (50) defined by a longitudinal mid-point of the stabilizing elements (162) of the string stabilizer (50).

Further, as discussed, in the preferred embodiment, the adjustable gauge stabilizer (30) is preferably located so that the drilling assembly (20) adjacent to the adjustable gauge stabilizer (30) will deflect as the adjustable gauge stabilizer (30) is adjusted between the extended gauge (42) and the retracted gauge (44) by an amount which is approximately coincidental with the difference in the radius of the adjustable gauge stabilizer (30) between the extended gauge (42) and the retracted gauge (44). Since the string stabilizer (50) is located a third axial distance (52) from the distal end (22) of the drilling assembly (20), which is greater than the second axial distance (38), this location will be along the drilling assembly (20) between the near bit stabilizer (28) and the string stabilizer (50).

Finally, the within invention is comprised of a method for drilling a borehole with the use of a drilling assembly positioned in the borehole. Preferably, the drilling assembly is comprised of the drilling assembly (20) as described herein. More particularly, in the preferred embodiment, the drilling assembly (20) is comprised of the drilling bit (26), preferably a reciprocatable hammer bit, the pneumatic hammer (34), the near bit stabilizer (28) and the adjustable gauge stabilizer (30), all as described above.

The method is comprised of the steps of adjusting the adjustable gauge stabilizer (30) to the retracted gauge (44) and drilling a build section. The build section is drilled in the borehole using the drilling bit (26) with the adjustable gauge stabilizer (30) adjusted to the retracted gauge (44). More particularly, the build section is drilled by reciprocating the drilling bit (26). Further, the method preferably includes the step of rotating the drilling bit (26) during drilling. Thus, the drilling bit (26) reciprocates and rotates at the same time while drilling the build section. In addition, while the drilling bit (26) may rotate independently of the drilling assembly (20), preferably, the drilling bit (26) rotates with rotation of the drilling assembly (20).

As well, In the preferred embodiment, the method is further comprised of the steps of adjusting the adjustable gauge stabilizer (30) to the extended gauge (42) and drilling a drop section. The drop section is drilled in the borehole using the drilling bit (26) with the adjustable gauge stabilizer (30) adjusted to the extended gauge (42). More particularly, the drop section is drilled by reciprocating the drilling bit (26). Further, similar to drilling the build section, the drilling bit (26) is preferably rotated during drilling. Thus, the drilling bit (26) reciprocates and rotates at the same time while drilling the drop section. In addition, while the drilling bit (26) may rotate independently of the drilling assembly (20), preferably, the drilling bit (26) rotates with rotation of the drilling assembly (20).

The embodiments of the invention in which an exclusive property or privilege is claimed are defined as follows:

1. A drilling assembly for use in directional drilling, wherein the drilling assembly has a nominal drilling assembly gauge and wherein the drilling assembly comprises:

(a) a drilling bit, wherein the drilling bit has a distal end which defines a distal end of the drilling assembly;

(b) a near bit stabilizer located a first axial distance from the distal end of the drilling assembly, wherein the near bit stabilizer has a near bit stabilizer gauge and wherein the near bit stabilizer gauge is greater than the nominal drilling assembly gauge;

(c) an adjustable gauge stabilizer located a second axial distance from the distal end of the drilling assembly, wherein the second axial distance is greater than the first axial distance, wherein the adjustable gauge stabilizer is adjustable between an extended gauge and a retracted gauge, and wherein the retracted gauge is less than the near bit stabilizer gauge;

wherein the drilling bit is supported in the drilling assembly such that a bit drop angle is created between the near bit stabilizer and the drilling bit, wherein a stabilizer angle is created between the near bit stabilizer and the adjustable gauge stabilizer, wherein the combination of the bit drop angle and the stabilizer angle results in a net build angle of the drilling assembly when the adjustable gauge stabilizer is adjusted to the retracted gauge, and wherein the combination of the bit drop angle and the stabilizer angle results in a net drop angle of the drilling assembly when the adjustable gauge stabilizer is adjusted to the extended gauge.

2. The drilling assembly as claimed in claim 1 wherein the drilling assembly is comprised of a hammer and wherein the drilling bit is comprised of a reciprocatable hammer bit.

3. The drilling assembly as claimed in claim 2 wherein the hammer bit is adapted to rotate with the drilling assembly as the hammer bit reciprocates.

4. The drilling assembly as claimed in claim 2 wherein the hammer bit is adapted to rotate independently of the drilling assembly as the hammer bit reciprocates.

5. A method for drilling a borehole with the use of a drilling assembly positioned in the borehole, the drilling assembly comprising a drilling bit having a distal end which defines a distal end of the drilling assembly, a near bit stabilizer located a first axial distance from the distal end of the drilling assembly, and an adjustable gauge stabilizer located a second axial distance from the distal end of the drilling assembly, the second axial distance being greater than the first axial distance, the adjustable gauge stabilizer being adjustable between an extended gauge and a retracted gauge, the drilling assembly having a net build angle when the adjustable gauge stabilizer is adjusted to the retracted gauge and having a net drop angle when the adjustable gauge stabilizer is adjusted to the extended gauge, the method comprising the following steps:

(a) adjusting the adjustable gauge stabilizer to the retracted gauge;

(b) drilling along a first deviated path in the borehole by drilling a build section in the borehole using the drilling bit with the adjustable gauge stabilizer adjusted to the retracted gauge;

(c) adjusting the adjustable gauge stabilizer to the extended gauge; and (d) drilling along a second deviated path in the borehole by drilling a drop section in the borehole using the drilling bit with the adjustable gauge stabilizer adjusted to the extended gauge.

6. The method as claimed in claim 5 further comprising the step of rotating the drilling bit during drilling.

7. The method as claimed in claim 6 wherein the drilling bit rotates with the drilling assembly.

8. The method as claimed in claim 6 wherein the drilling bit rotates independently of the drilling assembly.

9. A method for drilling a borehole with the use of a drilling, assembly positioned in the borehole, the drilling assembly comprising a hammer comprising a reciprocatable hammer bit having a distal end which defines a distal end of the drilling assembly, a near bit stabilizer located a first axial distance from the distal end of the drilling assembly, and an adjustable gauge stabilizer located a second axial distance from the distal end of the drilling assembly, the second axial distance being greater than the first axial distance, the adjustable gauge stabilizer being adjustable between an extended gauge and a retracted gauge, the drilling, assembly having a net build angle when the adjustable gauge stabilizer is adjusted to the retracted gauge and having a net drop angle when the adjustable gauge stabilizer is adjusted to the extended gauge, the method comprising the following steps:

(a) adjusting the adjustable gauge stabilizer to the retracted gauge;

(b) drilling along a first deviated path in the borehole by drilling a build section in the borehole by reciprocating the hammer bit with the adjustable gauge stabilizer adjusted to the retracted gauge;

(c) adjusting the adjustable gauge stabilizer to the extended gauge; and (d) drilling along a second deviated path in the borehole by drilling a drop section in the borehole by reciprocating the hammer bit with the adjustable gauge stabilizer adjusted to the extended gauge.

10. The method as claimed in claim 8 further comprising the step of rotating the hammer bit as the hammer bit reciprocates.

11. The method as claimed in claim 10 wherein the hammer bit rotates with the drilling assembly.

12. The method as claimed in claim 10 wherein the hammer bit rotates independently of the drilling assembly.

* * * * *

UNITED STATES PATENT AND TRADEMARK OFFICE

CERTIFICATE OF CORRECTION

PATENT NO. : 6,290,002 B1
DATED : September 18, 2001
INVENTOR(S) : Laurier E. Comeau et al.

It is certified that error appears in the above-identified patent and that said Letters Patent is hereby corrected as shown below:

Column 24,
Lines 2 and 11, delete "," after "drilling".
Line 28, delete "8" and insert -- 9 -- after "claim".

Signed and Sealed this

Fourteenth Day of May, 2002

*Attest:*

*Attesting Officer*

JAMES E. ROGAN
*Director of the United States Patent and Trademark Office*